US010668728B2

(12) United States Patent
Kanke et al.

(10) Patent No.: US 10,668,728 B2
(45) Date of Patent: Jun. 2, 2020

(54) INK JET RECORDING METHOD AND INK JET RECORDING APPARATUS

(71) Applicant: CANON KABUSHIKI KAISHA, Tokyo (JP)

(72) Inventors: Tsuyoshi Kanke, Yokohama (JP); Hiroshi Tomioka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,263

(22) Filed: Jun. 29, 2018

(65) Prior Publication Data

US 2019/0009552 A1 Jan. 10, 2019

(30) Foreign Application Priority Data

Jul. 4, 2017 (JP) ..... 2017-131062
Jun. 11, 2018 (JP) ..... 2018-111478

(51) Int. Cl.

| | |
|---|---|
| ***B41J 2/005*** | (2006.01) |
| ***B41J 2/165*** | (2006.01) |
| ***B41J 2/21*** | (2006.01) |
| ***B41J 11/00*** | (2006.01) |

(52) U.S. Cl.

CPC ..... *B41J 2/16505* (2013.01); *B41J 2/0057* (2013.01); *B41J 2/2103* (2013.01); *B41J 11/0015* (2013.01)

(58) Field of Classification Search

CPC .... B41J 2/0057; B41J 2/2103; B41J 11/0015; B41J 2/16505

See application file for complete search history.

(56) References Cited

U.S. PATENT DOCUMENTS 7,198,837 B1 4/2007 Endo et al.

FOREIGN PATENT DOCUMENTS

JP 2009-083314 A 4/2009
JP 2010-115854 A 5/2010

*Primary Examiner* — Lamson D Nguyen
(74) *Attorney, Agent, or Firm* — Venable LLP

(57) ABSTRACT

To provide an ink jet recording method capable of, after repeated contact of a porous layer of a liquid absorption member with a first image, suppressing adhesion of a coloring material to the porous layer and a partial loss of a recorded image. Provided is an ink jet recording method for recording an image on a recording medium with a water-based ink containing first and second inks. The method includes applying a coloring material-containing first ink to a first recording medium to form a coloring material layer, applying a second ink not containing a coloring material but containing resin particles onto the coloring material layer to form a resin layer and thereby forming a first image comprised of the coloring material layer and the resin layer; and bringing a porous layer of a liquid absorption member into contact with the first image to absorb a liquid component therefrom.

13 Claims, 2 Drawing Sheets

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

As an ink to be used in an ink jet recording method, a water-based ink has been used popularly. In order to immediately remove the liquid component in an ink, there is a method of drying a recording medium with warm air, infrared ray, or the like and then recording an image thereon. There is also a method of forming, as an intermediate image, a first image on a transfer body with a water-based ink, removing the liquid component contained in the first image by thermal energy or the like, and then transferring the resulting first image to a recording medium to record an image. An ink jet recording method using a transfer body is under investigation (refer to Japanese Patent Application Laid-Open No. 2009-83314). This ink jet recording method includes a step of applying a resin particle-containing ink and then a coloring material-containing ink to a transfer body to form a first image and a step of bringing a porous body into contact with the first image to remove the liquid component from the first image. Further, an ink jet recording method including applying a coloring material-containing ink and then a resin particle-containing ink to a recording medium to record an image is under investigation (refer to Japanese Patent Application Laid-Open No. 2010-115854).

SUMMARY OF THE INVENTION

As a result of investigation, the present inventors have found that recording many images by the ink jet recording method described in Japanese Patent Application Laid-Open No. 2009-83314 causes adhesion of the coloring material to the porous body and that an image obtained by transferring the first image on the transfer body to the recording medium is partially lost. In the ink jet recording method described in Japanese Patent Application Laid-Open No. 2010-115854, contact of the porous body with the first image to remove the liquid component from the first image is not disclosed.

An object of the invention is therefore to provide an ink jet recording method capable of, even after repeated contact of a porous layer possessed by a liquid absorption member with a first image, suppressing adhesion of the coloring material to the porous layer and at the same time, suppressing a partial loss of a recorded image. Another object of the invention is to provide an ink jet recording apparatus using the above-described ink jet recording method.

The above-described object is fulfilled by the invention described below. The ink jet recording method of the invention relates to an ink jet recording method of recording an image on a recording medium by making use of a water-based ink containing a first ink and a second ink. It includes an image formation step, that is, a step of applying first ink containing a coloring material to a first recording medium to form a coloring material layer, applying a second ink not containing a coloring material but containing resin particles onto the coloring material layer to form a resin layer and thereby forming a first image comprised of the coloring material layer and the resin layer and a liquid absorption step, that is, a step of bringing a porous layer possessed by a liquid absorption member into contact with the first image to absorb a liquid component from the first image.

The invention also provides an ink jet recording apparatus equipped with a unit of applying a first ink and then applying a second ink and a unit of bringing a porous layer possessed by a liquid absorption member into contact with a first image formed with the first ink and the second ink. In this apparatus, the first ink is a water-based ink containing a coloring material and the second ink is a water-based ink not containing the coloring material but containing resin particles.

According to the invention, an ink jet recording method and an ink jet recording apparatus capable of, even after repeated contact of the porous layer of the liquid absorption member with the first image, suppressing adhesion of the coloring material to the porous layer and at the same time, suppressing a partial loss of a recorded image.

Further features of the present invention will become apparent from the following description of exemplary embodiments with reference to the attached drawings.

DESCRIPTION OF THE EMBODIMENTS

Figure 1:
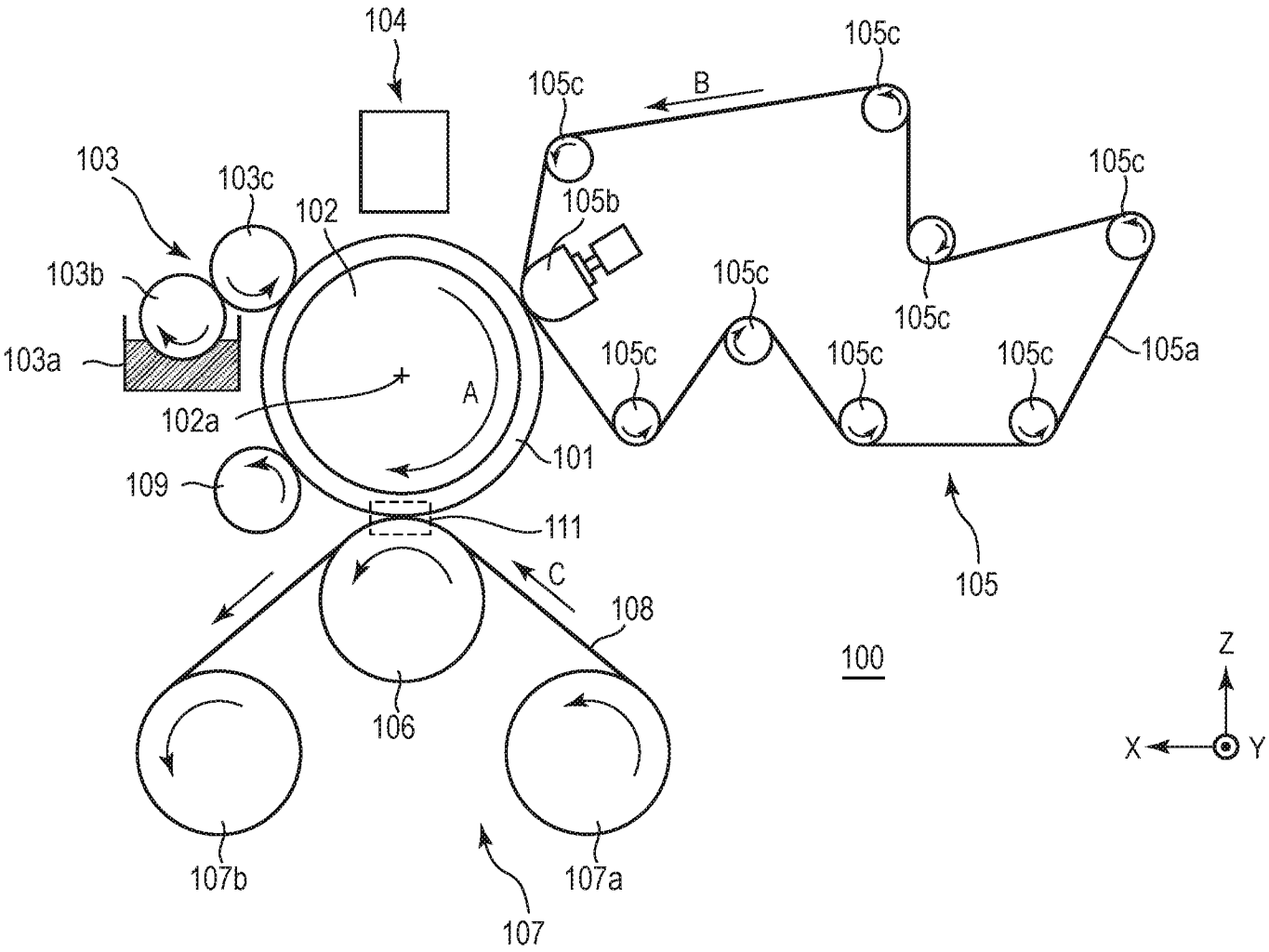
FIG. 1 is a schematic view showing one example of a transfer type ink jet recording apparatus to be used in the ink jet recording method of the invention.

Preferred embodiments of the present invention will now be described in detail in accordance with the accompanying drawings.

Embodiments of the invention will hereinafter be described in detail. The term "water-based ink" as used herein may be called "ink". The terms "first ink" and "second ink" may be called "ink" collectively. Values of various physical properties are at a temperature of 25° C. unless otherwise particularly specified. The terms "(meth) acrylic acid" and "(meth)acrylate" mean "acrylic acid and methacrylic acid" and "acrylate and methacrylate", respectively.

Without removing a liquid component from a first image by using a liquid absorption member such as porous body as in Japanese Patent Application Laid-Open No. 2010-115854, it is impossible to recognize problems, that is, adhesion of a coloring material to a porous layer and a partial loss of a recorded image which occurs precisely because of the use of the liquid absorption member. The ink jet recording method described in Japanese Patent Application Laid-Open No. 2009-83314 suppressed neither adhesion of the coloring material to the porous body nor partial loss of a recorded image after repeated contact of the porous body to the first image. The present inventors investigated the reason why adhesion of the coloring material to the porous layer and a partial loss of a recorded image could not be suppressed. Since the first image is formed by applying an ink containing neither a coloring material nor a reactant but containing resin particles and then applying a coloring material-containing ink to the transfer body so as to overlap the latter ink with the former ink, the first image tends to have the coloring material more on the surface side thereof. Contact of the porous body to the first image causes contact of it to the coloring material distributed more on the surface side of the first image, facilitating adhesion of the coloring material to the porous body. In particular, under severe conditions allowing repeated contact of the porous body to the first image, a portion of the porous body brought into contact with the first image wears and this may peel off the coloring material present on the surface side of the first image. As a result, the coloring material adheres to the porous layer. An image obtained by the transfer of the first image to the recording medium is therefore presumed to have a partial loss.

Considering that in order to suppress adhesion of a coloring material to a porous layer possessed by a liquid absorption member and a partial loss of a recorded image, it is necessary to prevent the uneven distribution of the coloring material on the surface side of the first image so as to prevent direct contact between the porous layer and the coloring material, the present inventors have completed the invention.

The ink jet recording method of the invention has an image formation step, that is, a step of, after application of a first ink to a first recording medium to form a coloring material layer, applying a second ink onto the coloring material layer to form a resin layer and thereby forming a first image comprised of the coloring material layer and the resin layer. The method further has a liquid absorption step, that is, a step of bringing a porous layer possessed by a liquid absorption member into contact with the first image to absorb a liquid component from the first image. Due to such constitution, even after repeated contact of the porous layer with the first image, the porous layer comes into contact with the resin layer present on the surface side of the first image, preventing direct contact of the porous layer with the coloring material in the first image. Adhesion of the coloring material to the porous layer and also a partial loss of an image recorded on the recording medium can therefore be suppressed.

The ink jet recording method of the invention, whether it is the following method (1) or (2), can suppress the adhesion of the coloring material to the porous layer and a partial loss of an image.

(1) A method of transferring a first image, which has been formed by applying an ink to a first recording medium, to a recording medium to record an image.

(2) A method of applying an ink directly to a recording medium to record an image.

In the case of (1), the first recording medium is a transfer body and this ink jet recording method preferably has, after a liquid absorption step, a transfer step, that is, a step of transferring the first image on the transfer body to the recording medium. Ink jet recording apparatuses usable in the methods (1) and (2), respectively, will next be described. For the convenience sake, an ink jet recording apparatus usable in the method (1) will be called "transfer type ink jet recording apparatus", while that usable in the method (2) will be called "direct recording type ink jet recording apparatus".

<Transfer Type Ink Jet Recording Apparatus>

FIG. 1 is a schematic view showing one example of a transfer type ink jet recording apparatus to be used in the ink jet recording method of the invention. The ink jet recording method of the invention has preferably a reaction liquid application step (which will be described in detail later) for applying a reaction liquid containing a reactant to a first recording medium prior to the image formation step so that the structure of an apparatus including a reaction liquid applying unit will next be described. The first recording medium when the transfer type ink jet recording apparatus is used is a transfer body.

A transfer type ink jet recording apparatus 100 is a sheet feed type ink jet recording apparatus which manufactures a recorded product by transferring a first image to a sheet-shaped recording medium 108 via a transfer body 101. Directions X, Y and Z mean a width direction (entire length direction), depth direction and height direction, respectively, of the transfer type ink jet recording apparatus 100. The recording medium is conveyed in the direction X.

The transfer type ink jet recording apparatus 100 has, as shown in FIG. 1, the transfer body 101 supported by a support member 102 and a reaction liquid applying unit 103 for applying a reaction liquid to the transfer body 101. It further has an ink applying unit 104 equipped with a recording head for applying an ink to the transfer body 101 to which the reaction liquid has been applied and forming a first image, a liquid absorption unit 105 for absorbing a liquid component from the first image, and a pressing member 106 for transferring the first image to the recording medium 108. The recording head ejects an ink through an ink jet system. The transfer type ink jet recording apparatus 100 may have a transfer body cleaning member 109 for cleaning the surface of the transfer body 101 after transfer. The transfer body 101, the reaction liquid applying unit 103, the recording head possessed by the ink applying unit 104, the liquid absorption unit 105 and the transfer body cleaning member 109 each have, in the direction Y, a length corresponding to the recording medium 108 used.

The transfer body 101 rotates in the direction of the arrow A with a rotation axis 102*a* of the support member 102 as a center. The transfer body 101 rotates with the rotation of this support member 102. A reaction liquid is applied from the reaction liquid applying unit 103 to this rotating transfer body 101. Then, an ink is applied from the ink applying unit 104 to a region of the transfer body 101 to which the reaction liquid has been applied. In such a manner, a first image is formed on the transfer body 101. By the rotation of the transfer body 101, the first image formed on the transfer body 101 moves to a position where it comes into contact with a liquid absorption member 105*a* possessed by the liquid absorption unit 105.

The liquid absorption member 105*a* rotates in synchronization with the rotation of the transfer body 101. The first image formed on the transfer body 101 comes into contact with the rotating liquid absorption member 105*a*. During this contact state, the liquid absorption member 105*a* absorbs a liquid component from the first image. From the standpoint of efficient absorption of the liquid component, the liquid absorption member 105*a* is preferably pressed by the transfer body 101 at a certain pressing force.

Since the first image is formed with the first ink and the second ink, the term "absorption of a liquid component in the ink" means absorption of a liquid component in the first ink and the second ink. When a reaction liquid is applied to a transfer body, absorption of a liquid component from an ink means absorption of a liquid component from the reaction liquid, the first ink and the second ink. By the absorption of the liquid component, the liquid component is removed from the first image so that absorption of the liquid component is, in other words, concentration of the ink. Concentration of the ink decreases the liquid component in the ink and thereby increases a ratio of a solid component such as coloring material and resin in the ink to the liquid component.

The first image in which the ink is concentrated as a result of absorption of the liquid component moves to a region where it comes into contact with the recording medium 108 by the rotation of the transfer body 101. The first image and the recording medium 108 are brought into contact with each other by being pressed from the side of the pressure member 106 while being sandwiched between the transfer body 101 and the pressing member 106. When a roller type transfer body 101 and a columnar pressing member 106 are used, the first image and the recording medium 108 come into linear contact along the direction Y. At this time, when the transfer body 101 is comprised of a material having elasticity, the transfer body 101 is dented by pressing force and the first image and the recording medium 108 come into surface contact. The contact point or contact surface between the first image and the recording medium 108 is regarded as a "region" and a portion containing this region is designated as a "transfer unit 111". During contact of the liquid component-absorbed first image with the recording medium 108, the pressing member 106 presses the transfer body 101 to transfer the first image to the recording medium 108. A second image transferred to the recording medium 108 is a reverse image of the first image formed on the transfer body 101. The term "second image" as used herein means a final image and the term "first image" means an image other than the final image. Formation of the final image may be followed by thermal fixing or lamination.

When the reaction liquid is applied to the transfer body with a roller or the like, the reaction liquid is applied all over the transfer body. In a region where the reaction liquid has been applied but the ink has not been applied, the reaction liquid exists without reacting with the ink. This means that the liquid absorption member 105*a* absorbs a liquid component not only from the first image but it comes into contact with the reaction liquid which has not reacted with the ink and absorbs also from the reaction liquid. During absorption of a liquid component from the first image, therefore, it removes the liquid component also from the reaction liquid which has been applied to the transfer body but not has reacted with the ink. The liquid component contained in the ink or the reaction liquid has fluidity and almost a constant volume without having a particular shape. More specifically, an aqueous medium or the like which is a component contained in the ink or reaction liquid is a liquid component.

Next, main units constituting the transfer type ink jet recording apparatus such as [1] transfer body, [2] support member, [3] reaction liquid applying unit, [4] ink applying unit, [5] liquid absorption unit, [6] pressing member for transfer, [7] recording medium and [8] recording medium conveying unit will be described.

[1] Transfer Body 101

The transfer body 101 has a surface layer as a first image formation surface. Examples of a material constituting the surface layer include resins and ceramics. From the standpoint of durability, materials having a high compressive elastic modulus are preferred. It may be subjected to surface treatment to have improved wettability with the reaction liquid, transferability and the like. The surface layer of it may have any shape.

The transfer body has preferably a compression layer having a function of absorbing pressure variation between the surface layer and the support member. The compression layer absorbs deformation of the surface layer of the transfer body and disperses local pressure variation if any so that the transfer body provided with the compression layer can maintain good transferability even during high-speed recording. Examples of a material constituting the compression layer include materials having elasticity such as rubber materials. Among them, rubber materials obtained by mixing a foaming agent, hollow fine particles and a filler such as salt together with a vulcanizing agent and a vulcanizing accelerator and formed as a porous body are preferred. When pressure variation occurs, a void portion is compressed with a volume change so that deformation of such materials in a direction other than a compressing direction is small and they can have improved transferability and durability. Examples of the rubber materials formed as a porous body include those having a continuous void structure having voids connected to each other and those having an independent void structure having voids independent of each other.

The transfer body preferably has an elastic layer between the surface layer and the compression layer. Examples of a material constituting the elastic layer include resin materials and ceramic materials. Among them, due to easy processability, a small change in elastic modulus due to temperature and excellent transferability, materials having elasticity such rubber materials are preferably used.

Layers constituting the transfer body (surface layer, elastic layer, compression layer) can be bonded to one another using an adhesive or double-sided tape. In order to suppress transverse elongation and keep resilience at the time of installing the transfer body in the apparatus, a reinforcing layer having a high compressive modulus may be provided. As the reinforcing layer, a woven fabric or the like can be used. The transfer body can be manufactured using, not to mention of the surface layer, the elastic layer and the compression layer in any combination.

The size of the transfer body can be selected freely depending on a recording rate or image size. Examples of the shape of the transfer body include sheet shape, roller shape, belt shape and endless web shape. Of these, a sheet-shaped, roller-shaped, or endless web-shaped transfer body is preferred.

[2] Support Member 102

The transfer body 101 is supported by the support member 102. For the support of the transfer body, an adhesive or double-sided tape can be used. Alternatively, a fixing member comprised of a material such as metal, ceramic or resin is attached to the transfer body and with this fixing member, the transfer body may be fixed to the support member 102.

The support member 102 is required to have certain structural strength from the standpoint of conveyance accuracy and durability. Examples of a material constituting the support member include metal materials, ceramic materials and resin materials. Of these, metal materials such as aluminum are preferably used in view of rigidity enough to withstand the stress at the time of transfer, size accuracy and also reduction of the inertia during operation to improve the control responsivity.

[3] Reaction Liquid Applying Unit 103

The ink jet recording method of the invention preferably has a reaction liquid applying step for applying a reaction liquid to the first recording medium prior to the image formation step. When the reaction liquid is brought into contact with the ink, the reactant can aggregate an anionic group-containing component (resin, self-dispersible pigment, or the like) in the ink. Even if a portion of the porous layer to be brought into contact with the first image wears, the aggregated component in the ink can more effectively suppress adhesion of the coloring material to the porous layer and can more effectively suppress a partial loss of a recorded image. In the image formation step, the first ink is applied preferably so as to overlap with at least a portion of the region to which the reaction liquid has been applied. After application of the first ink, the reaction liquid may be applied further so as to overlap at least partially with the region to which the first ink has been applied.

The transfer type ink jet recording apparatus has a reaction liquid applying unit 103 for applying the reaction liquid to the transfer body 101. In FIG. 1, shown as the reaction liquid applying unit 103 is a gravure offset roller having a reaction liquid storage unit 103*a* for storing therein the reaction liquid and reaction liquid applying members 103*b* and 103*c* for applying the reaction liquid in the reaction liquid storage unit 103*a* to the transfer body 101.

The reaction liquid applying unit is only required to be able to apply the reaction liquid to the transfer body and examples of it include a gravure offset roller and an ink jet system recording head. The reaction liquid is particularly preferably applied to the transfer body with a roller.

[4] Ink Applying Unit 104

The transfer type ink jet recording apparatus has an ink applying unit 104 for applying an ink to the transfer body 101. In the image formation step, the second ink is preferably applied so as to entirely cover the coloring material layer. Application of the second ink so as to entirely cover the second layer hinders the existence of a portion of the first image from which the coloring material layer is exposed. This makes it possible to more effectively suppress adhesion of the coloring material to the porous layer and more effectively suppress a partial loss of a recorded image even after repeated contact of the porous layer with the first image.

The ink applying unit preferably ejects an ink from an ink jet system recording head and applies the ink to a recording medium. Examples of an ink ejection system include application of dynamic energy to an ink and application of thermal energy to an ink. Of these, an ink ejection system by applying thermal energy to an ink is preferred.

The recording head is a line type one arranged along the direction Y and it has ejection orifices of an ink arranged over the entire region in the width direction of the recording medium. The recording head has an ejection orifice surface with ejection orifice rows and a space between the ejection orifice surface and the transfer body 101 facing therewith can be set at about several mm.

The ink applying unit 104 may have a plurality of recording heads to apply respective first inks of cyan, magenta, yellow and black (CMYK) colors and the second ink to the transfer body. For the formation of the first image with, for example, the four first CMYK inks and the second ink, the ink applying unit should have five recording heads for ejecting the four first CMYK inks and the second ink, respectively. These recording heads are arranged in a direction X.

After application of the first ink to the transfer body to form a coloring material layer, a second ink not containing a coloring material but containing resin particles is applied onto the coloring material layer to form a resin layer. Thus, a first image comprised of the coloring material layer and the resin layer is formed. After application of the first ink, the second ink should therefore be applied to the transfer body 101. In a rotation direction of the surface of the transfer body 101 located between the ejection orifice of the recording head and a rotation axis 102*a* at a position corresponding to the ejection orifice in the Y-axis direction, the recording head for ejecting the first ink should be placed on the upstream side of the ink applying unit. Further, a recording head for ejecting the second ink should be placed on the downstream side of the ink applying unit.

[5] Liquid Absorption Unit 105

The liquid absorption unit 105 has a liquid absorption member 105*a* and a pressing member 105*b* for liquid absorption for pressing the liquid absorption member 105*a* against the first image of the transfer body 101. The liquid absorption member 105*a* and the pressing member 105*b* can have the following shapes, respectively. Examples include a constitution in which as shown in FIG. 1, the pressing member 105*b* has a columnar shape and the liquid absorption member 105*a* has a belt-like shape and the columnar pressing member 105*b* presses the belt-like liquid absorption member 105*a* against the transfer body 101 and a constitution in which the pressing member 105*b* has a columnar shape, the liquid absorption member 105*a* is attached to the surface around the columnar pressing member 105*b* and the liquid absorption member 105*a* possessed by the pressing member 105*b* is pressed against the transfer body. The liquid absorption member 105*a* has preferably a belt-like shape in consideration of a space in the ink jet recording apparatus. The liquid absorption unit 105 having the belt-like liquid absorption member 105*a* may have an extending member for extending the liquid absorption member 105*a*. A member indicated by 105*c* is an extending roller as the extending member. The pressing member 105*b* is also shown as a roller in FIG. 1 like the extending roller, but the pressing member is not limited to it.

The liquid absorption unit 105 causes the liquid absorption member 105*a* having a porous layer to absorb therein the liquid component contained in the first image by bringing the liquid absorption member 105*a* into contact with the first image by means of the pressing member 105*b*. As a method of causing absorption of the liquid component contained in the first image, as well as the present method of bringing the liquid absorption member into contact with the first image, a method by heating, a method by sending low-humidity air, and a method of reducing pressure may be used in combination. In addition, these methods may be applied to the first image before or after absorption of the liquid component to cause further absorption of the liquid component.

[Liquid Absorption Member]

Through contact with the first image, the porous layer possessed by the liquid absorption member 105*a* absorbs at least a portion of the liquid component from the first image. Such a liquid absorption member having a porous layer rotates in conjunction with rotation of the transfer body 101. The liquid absorption member therefore has preferably a shape permitting repetitive liquid absorption and examples include an endless belt-like shape and a drum-like shape. After a certain region of the liquid absorption member having such a shape comes into contact with the first image and absorbs the liquid component therefrom, the liquid absorption member rotates in a direction of the arrow B and this region moves from the position of the first image. Until the liquid absorption member continues rotating and this region comes into contact with a new first image, the liquid component absorbed from the previous first image and therefore contained in the porous layer is preferably removed from the porous member. The liquid component contained in the porous member can be removed by a method of absorbing it from the back surface of the porous member, a method of making use of a member squeezing the porous member, or the like. The liquid component is removed in such a manner so that when the certain region of the porous member comes into contact with a new first image, it can efficiently absorb the liquid component contained in this first image again.

[Porous Layer]

To achieve uniformly high air permeability, the porous layer is preferably thin. The air permeability can be expressed as a Gurley value specified by JIS P8117. The Gurley value is preferably 10 seconds or less. The Gurley value is preferably 1 second or more. Thinning of a porous body, however, leads to a decrease in the total void volume of the porous layer so that the maximum amount of the liquid component absorbed by the porous layer decreases, sometimes making it impossible to sufficiently absorb the liquid component contained in the first image. To achieve sufficient absorption of the liquid component contained in the first image, a porous body comprised of, in addition to the porous layer, some layers having a void greater than that of the porous layer can be used. The liquid absorption member is only required to have a porous layer as a layer to be brought into contact with the first image and a layer not brought into contact with the first layer is not necessarily a porous layer.

The porous body will next be described with a porous layer to be brought into contact with the first image as a first layer and a layer stacked on a surface of the first layer on a side opposite to the first image as a second layer. When it is made of a multilayer, the constitution of the multilayer will also be indicated successively in stacking order, starting with the first layer. In the present specification, the first layer may be called "absorption layer" and the second layer and layers subsequent thereto may be called "support layers".

<First Layer>

As a material constituting the first layer, either of a hydrophilic material having a contact angle with water of less than 90° or a water repellent material having a contact angle of 90° or more may be used. Examples of the hydrophilic material include fiber materials such as cellulose and resin material such as polyacrylamide resin and they may be used either singly or in combination. A water repellent material as described later may be used after hydrophilic treatment is given to its surface. Examples of the hydrophilic treatment include sputter etching, exposure to radiation or $H_2O$ ion, and exposure to excimer (ultraviolet) laser light.

When the hydrophilic material is used, it is preferably a hydrophilic material having a contact angle with water of 60° or less. The hydrophilic material has action of sucking up a liquid component, particularly water by its capillary force. From the viewpoint of suppressing adhesion of the coloring material to the first layer or enhancing the cleaning property, a water repellent resin or the like having low surface free energy is preferably used as a material of the first layer. Of these, a fluorine-based resin is preferred. When the water repellent material is used, on the other hand, action of sucking up the liquid component through capillary force hardly occurs different from the hydrophilic material so that it may take time for the water repellent material to suck up the liquid component. The first layer is therefore preferably impregnated with a treatment liquid having a contact angle with the first layer of less than 90°. The first layer can be impregnated with this treatment liquid by applying the liquid from the surface of the liquid absorption member to be brought into contact with an ink before the porous layer possessed by the liquid absorption member is brought into contact with the first image. The treatment liquid preferably contains water and a water-soluble organic solvent. The water is preferably deionized water. As the water-soluble organic solvent, an alcohol such as ethanol or isopropyl alcohol can be used. Alternatively, the treatment liquid may be prepared by mixing them with a component such as surfactant. Examples of a method of applying the treatment liquid include immersion and dropwise addition.

The first layer has preferably a thickness of 400 μm or less, more preferably 1 μm or more to 350 μm or less. The thickness of the first layer can be determined by measuring thickness at any 10 points with a micrometer and then calculating an average of them. More specifically, a digimatic straight formula outside micrometer ("OMV-25MX", product of Mitsutoyo Corporation) or the like can be used.

The first layer can be formed by a known method of forming a thin porous film. For example, it can be formed by extruding a resin material into a sheet and then stretching the resulting sheet into a predetermined thickness. It can also be formed as a porous film by adding a plasticizer such as paraffin to the material used in extrusion and then removing the plasticizer by heating or the like at the time of stretching. The pore size can be controlled by adjusting the addition amount of the plasticizer, a percent of stretch, or the like as needed.

<Second Layer>

The second layer preferably has air permeability. More specifically, it is nonwoven fabric, woven fabric or the like. Examples of a material constituting the second layer include materials having a contact angle with a second ink equal to or lower than that of the first layer to prevent the backflow of the liquid absorbed in the first layer. Specific examples include resin materials such as olefin resins and urethane resins. The pore size of the second layer is preferably larger than that of the first layer.

<Third Layer>

The porous layer may be comprised of three or more layers. As the third layer or layers subsequent thereto, use of nonwoven fabric is preferred from the standpoint of rigidity. Examples of a material constituting the third layer are similar to those of the second layer.

<Other Members>

The liquid absorption member may have, in addition to the porous body having the above-described stacked structure, a reinforcing member for reinforcing the side surface of the liquid absorption member. When a belt-shaped porous body is formed by connecting the sheet-shaped porous bodies at the longitudinal-direction ends thereof, a joining member such as tape made of a non-porous material may be used. The joining member may be placed preferably at a position not in contact with the first image or placed at regular intervals.

<Manufacturing Method of Porous Body>

As a method of manufacturing the porous body having a stacked structure, two or more layers may only be overlapped with each other or they may be bonded with an adhesive or heat. From the standpoint of air permeability, not bonding with an adhesive but bonding of a plurality of layers with heat is preferred. They may be bonded by heating to melt a portion of the layers or may be bonded to each other by interposing a fusing material such as hot melt powder between the layers and then heating. When three or more layers are stacked one after another, they may be stacked simultaneously or successively. In the latter case, the stacking order can be determined as needed. When heating is necessary for bonding two or more layers, they may be bonded while applying a pressure to the porous body with a heated roller. Various conditions and constitution in the liquid absorption unit 105 will next be described in detail.

<Pressure Applying Conditions>

When the pressure of the liquid absorption member to be brought into contact with the first image of the transfer body is 2.9 $N/cm^2$ (0.3 $kg/cm^2$) or more, solid-liquid separation of the liquid component contained in the first image can be achieved in a shorter time and the liquid component contained in the first image can be removed efficiently. The pressure of the liquid absorption member is a nip pressure between the transfer body and the liquid absorption member. It can be determined, for example, by measuring the surface pressure by means of a pressure distribution measurement system and dividing the load in a pressure applied region by an area. More specifically, a surface pressure distribution measurement system ("I-SCAN", product of Nitta Corporation) or the like can be used.

<Contact Time>

Contact time for bringing the porous layer possessed by the liquid absorption member 105*a* into contact with the first image is preferably 50 msec or less in order to suppress adhesion of the coloring material to the porous layer as much as possible. The contact time can be determined by dividing the pressure detection width in the movement direction of the transfer body in the above-described surface pressure measurement by the movement speed of the transfer body.

[6] Pressing Member 106 for Transfer

After the liquid component is absorbed from the first image, the resulting first image is transferred to the recording medium 108 at the transfer unit 111. The constitution of the apparatus and conditions at the time of transfer will next be described.

By using the pressing member 106 for transfer, the first image is brought into contact with the recording medium 108, the first image is transferred to the recording medium and a second image is finally recorded. Since the first image from which the liquid component has been absorbed is transferred to the recording medium, curling, cockling or the like can be suppressed effectively.

The pressing member 106 is required to have a certain degree of structural strength from the standpoint of conveyance accuracy or durability of the recording medium 108. Examples of a material constituting the pressing member 106 include metal materials, ceramic materials, and resin materials. Of these, metal materials such as aluminum are preferably used in view of rigidity enough to withstand the stress at the time of transfer, size accuracy and also reduction of the inertia during operation to improve the control responsivity. Alternatively, the above-described materials may be used in combination.

The time (pressing time) of pressing the transfer body with the pressing member 106 for transferring the first image to the recording medium 108 is preferably 5 msec or more to 100 msec or less from the standpoint of smooth transfer and suppression of the damage of the transfer body. The term "pressing time" means the time during which the recording medium 108 and the transfer body 101 are in contact. The pressing time can be determined by measuring the surface pressure by means of a pressure distribution measurement system and dividing the conveyance-direction length of the pressed region by a conveyance speed. More specifically, a surface pressure distribution measurement system ("I-SCAN", product of Nitta Corporation) or the like can be used.

The pressing pressure (pressing force) of the pressing member 106 against the transfer body 101 for transferring the first image to the recording medium 108 is preferably a pressure under which transfer is performed smoothly and at the same time, damage of the transfer body is suppressed. The pressure is therefore preferably 9.8 $N/cm^2$ (1 $kg/cm^2$) or more to 294.2 $N/cm^2$ (30 $kg/cm^2$) or less. The term "pressing force" means a nip pressure between the recording medium 108 and the transfer body 101. The pressing force can be determined by measuring the surface pressure by means of a pressure distribution measurement system and dividing a load in the pressed region by an area. More specifically, a surface pressure distribution measurement system ("I-SCAN", product of Nitta Corporation) or the like can be used.

The temperature at the time when the pressing member 106 presses the transfer body 101 for transferring the first image to the recording medium 108 is preferably the glass transition point or more or the softening point or more, each of the resin component contained in the first image. Depending on the properties of the resin component, however, a heating unit for heating the first image of the transfer body 101, the transfer body 101, and the recording medium 108 is preferably provided for temperature adjustment. Examples of the shape of the pressing member 106 include a roller shape.

[7] Recording Medium 108

Examples of the recording medium 108 include a sheet which may be wound into a roll and a sheet cut into a predetermined size. Examples of a material constituting the recording medium 108 include films made of paper, plastics or a metal, wood boards and corrugated boards.

[8] Recording Medium Conveyance Unit 107

The recording medium conveyance unit 107 for conveying the recording medium 108 in the direction of the arrow C may be any unit insofar as it can convey the recording medium and as shown in FIG. 1, it can be comprised of a recording medium delivery roller 107*a* and a recording medium winding roller 107*b*. The conveyance speed of the recording medium 108 is preferably determined in consideration of the speed required in each step.

<Direct Recording Type Ink Jet Recording Apparatus>

Figure 2:
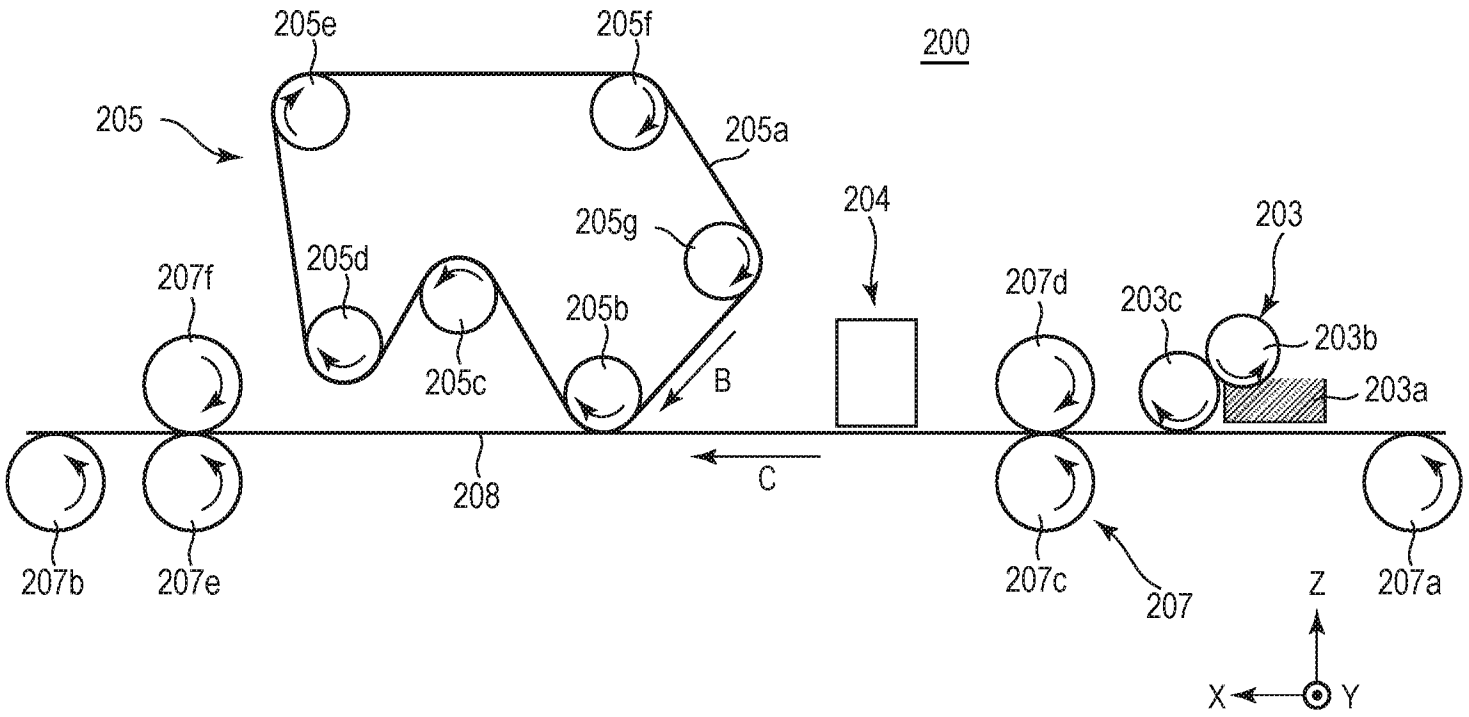
FIG. 2 is a schematic view showing one example of a direct recording type ink jet recording apparatus to be used in the ink jet recording method of the invention.

FIG. 2 is a schematic view showing one example of a direct recording type ink jet recording apparatus to be used in the ink jet recording method of the invention. A first recording medium used in the direct recording type ink jet recording apparatus 200 is not a transfer body but a generally used recording medium. When used in the transfer type apparatus, it is a "recording medium onto which a first image is transferred". Different from the above-described transfer type ink jet recording apparatus, the direct recording type ink jet recording apparatus has none of the transfer body 101, the support member 102, the pressing member 106 for transfer and the transfer body cleaning member 109. It forms a first image on a recording medium 208 and finally records a second image. Units and members other than those described above such as a reaction liquid applying unit 203, an ink applying unit 204, a liquid absorption unit 205 for absorbing a liquid component contained in the first image by means of a liquid absorption member 205*a* and the recording medium 208 can each have a constitution similar to that of the transfer type ink jet recording apparatus.

In FIG. 2, shown as the reaction liquid applying unit 203 is a gravure offset roller having a reaction liquid storage unit 203*a* for storing therein the reaction liquid and reaction liquid applying members 203*b* and 203*c* for applying the reaction liquid in the reaction liquid storage unit 203*a* to the recording medium 208. The liquid absorption unit 205 has the liquid absorption member 205*a* rotating in the direction of the arrow B and a pressing member 205*b* for liquid absorption for pressing the liquid absorption member 205*a* against the first image of the recording medium 208. The shapes of the liquid absorption member 205*a* and the pressing member 205*b* are similar to those of the transfer type, respectively. The liquid absorption unit 205 may have an extending member for extending the liquid absorption member. In FIG. 2, extending rollers as the extending member are indicated by 205*c*, 205*d*, 205*e*, 205*f* and 205*g*, respectively. The number of the extending rollers is not limited to five as shown in FIG. 2 and the required number of them may be placed according to the constitution or size of the unit. The ink applying unit for applying an ink to the recording medium 208 by means of the ink applying unit 204 and the liquid absorption unit for bringing the liquid absorption member 205*a* into contact with the first image of the recording medium to absorb the liquid component therefrom may be provided with a recording medium support member, not shown in the drawing, for supporting the recording medium from the back surface thereof. Examples of the recording medium conveyance unit 207 for conveying the recording medium 208 in the direction of the arrow C have a recording medium delivery roller 207*a*, a recording medium winding roller 207*b* and recording medium conveyance rollers 207*c*, 207*d*, 207*e* and 207*f* as shown in FIG. 2.

<First Ink>

Components constituting the first ink to be used in the invention will next be described in detail.

(Coloring Material)

As the coloring material, pigments or dyes can be used. The content of the coloring material in the first ink is preferably 0.5 mass % or more to 15.0 mass % or less based on the total mass of the first ink, with 1.0 mass % or more to 10.0 mass % or less being more preferred.

Specific examples of the pigment include inorganic pigments such as carbon black and titanium oxide and organic pigments such as azo, phthalocyanine, quinacridone, isoindolinone, imidazolone, diketopyrrolopyrrole and dioxazine.

As the pigment, when classified by a dispersing method, a resin-dispersible pigment using a resin as a dispersant or a self-dispersible pigment having a hydrophilic group-bonded particle surface can be used. As well, a resin bonded pigment obtained by chemically bonding a resin-containing organic group to the particle surface of the pigment or a microcapsule pigment having a particle surface coated with a resin or the like can be used.

The resin dispersant for dispersing a pigment in an aqueous medium is preferably that capable of dispersing a pigment in an aqueous medium by the action of its anionic group. As the resin dispersant, resins described later can be used preferably, with water-soluble resins being more preferred. A mass ratio of the content (mass %) of the pigment to the content of the resin dispersant (pigment/resin dispersant) is preferably 0.3 time or more to 10.0 times or less.

As the self-dispersible pigment, usable are those having an anionic group such as carboxylic acid group, sulfonic acid group or phosphonic acid group bonded to the surface of pigment particles directly or via another atomic group (—R—). The anionic group may be present in either of an acid or salt form. In the latter case, either a portion or the whole of the salt may be dissociated. Examples of a cation which is the counter ion of the anionic group in salt form include alkali metal cations, ammonium and organic ammoniums. Specific examples of the another atomic group (—R—) include linear or branched alkylene groups having 1 to 12 carbon atoms, arylene groups such as phenylene and naphthylene, carbonyl groups, imino groups, amide groups, sulfonyl groups, ester groups and ether groups. As the another atomic group, these groups may be used in combination.

As the dye, those having an anionic group are preferably used. Specific examples of the dye include azo, triphenylmethane, (aza)phthalocyanine, xanthene and anthrapyridone.

Of these, the coloring material is preferably the pigment, more preferably the resin-dispersible pigment.

(Resin)

A resin can be incorporated in the first ink. The content (mass %) of the resin in the first ink is preferably 0.1 mass % or more to 20.0 mass % or less based on the total mass of the first ink, with 0.5 mass % or more to 15.0 mass % or less being more preferred.

The resin can be added to the first ink for the purpose of (i) stabilizing the dispersion state of the pigment, that is, serving as the above-described resin dispersant or an auxiliary agent thereof, (ii) improving various properties of an image to be recorded, and the like. Examples of the form of the resin include block copolymers, random copolymers and graft copolymers, and combinations thereof. The resin may be dissolved as a water-soluble resin in an aqueous medium or dispersed as resin particles in an aqueous medium. The resin particles do not necessarily embrace the coloring material therein.

In the invention, when the resin is water soluble, it means that by neutralization of the resin with an alkali equivalent to the acid value of the resin, the resin does not form particles whose particle size can be measured by a dynamic light scattering method. Whether the resin is water soluble or not can be determined by the following method. First, a liquid containing a resin (resin solid content: 10 mass %) neutralized with an alkali (sodium hydroxide, potassium hydroxide, or the like) equivalent to an acid value is prepared. Then, the liquid thus prepared is diluted to 10 times (based on volume) with pure water to prepare a sample solution. The particle size of the resin in the sample solution is measured by the dynamic light scattering method. If particles with a particle size are not measured, the resin can be determined as water soluble. The measurement conditions at this time can be set, for example, as follows: SetZero: 30 seconds, measurement times: 3, and measurement time: 180 seconds. As a particle size distribution analyzer, a dynamic light scattering system particle size distribution analyzer (for example, "UPA-EX150"; product of NIKKISO) can be used. It is needless to say that the particle size distribution analyzer and measurement conditions are not always limited to the above-described ones.

The resin, when it is water soluble, has preferably an acid value of 100 mgKOH/g or more to 250 mgKOH/g or less, while resin particles have preferably an acid value of 5 mgKOH/g or more to 100 mgKOH/g or less. The weight average molecular weight of the resin, when it is water soluble, is preferably 3,000 or more to 15,000 or less, while that of resin particles is preferably 1,000 or more to 2,000,000 or less. The volume-based cumulative particle size at 50% of the resin particles as measured by the dynamic light scattering method (under measurement conditions similar to those described above) is preferably 100 nm or more to 500 nm or less.

Examples of the resin include acrylic resins, urethane resins and olefin resins. Of these, acrylic resins and urethane resins are preferred.

Acrylic resins have preferably a hydrophilic unit and a hydrophobic unit as a constitution unit. Of these, acrylic resins having a hydrophilic unit derived from (meth)acrylic acid and a hydrophobic unit derived from at least one of an aromatic ring-containing monomer and a (meth)acrylate-based monomer are preferred. Particularly preferred are resins having a hydrophilic unit derived from (meth)acrylic acid and a hydrophobic unit derived from at least one of styrene and α-methylstyrene monomers. These resins easily cause interaction with the pigment so that they can preferably be used as a resin dispersant for dispersing the pigment.

The hydrophilic unit is a unit having a hydrophilic group such as anionic group. The hydrophilic unit can be formed, for example, by polymerizing a hydrophilic monomer having a hydrophilic group. Specific examples of the hydrophilic monomer having a hydrophilic group include acidic monomers having a carboxylic acid group such as (meth) acrylic acid, itaconic acid, maleic acid or fumaric acid and anionic monomers such as anhydrides or salts of these acidic monomers. Examples of a cation constituting the salt of the acidic monomer include ions such as lithium, sodium, potassium, ammonium, and organic ammonium. The hydrophobic unit does not have a hydrophilic group such as anionic group. The hydrophobic unit can be obtained by polymerizing a hydrophobic monomer having no hydrophilic group such as anionic group. Specific examples of the hydrophobic monomer include aromatic ring-containing monomers such as styrene, α-methylstyrene and benzyl (meth)acrylate and (meth)acrylate-based monomers such as methyl (meth)acrylate, butyl (meth)acrylate and 2-ethylhexyl (meth)acrylate.

The urethane resin can be obtained, for example, by reacting a polyisocyanate with a polyol. It may be obtained by reacting, in addition to them, with a chain extending agent. Examples of the polyolefin resin include polyethylene and polypropylene.

(Aqueous Medium)

The first ink may contain water or an aqueous medium which is a mixed solvent of water and a water-soluble organic solvent. The water is preferably deionized water or ion exchanged water. The content (mass %) of the water in the first ink is preferably 50.0 mass % or more to 95.0 mass % or less based on the total mass of the first ink. The content (mass %) of the water-soluble organic solvent in the first ink is preferably 3.0 mass % or more to 50.0 mass % or less based on the total mass of the first ink. As the water-soluble organic solvent, any of those usable for ink jet inks such as alcohols, (poly)alkylene glycols, glycol ethers, nitrogen-containing compounds, and sulfur-containing compounds can be used.

(Other Additives)

The first ink may contain, in addition to the above-described components, various additives such as anti-foaming agent, surfactant, pH regulator, viscosity modifier, rust preventive, antiseptic agent, mildew proofing agent, antioxidant and reduction preventive as needed.

<Second Ink>

The second ink does not contain a coloring material but contains resin particles. The content (mass %) of the reactant in the second ink is preferably 0.1 mass % or less, more preferably 0.0 mass %. Components constituting the second ink to be used in the invention will next be described in detail.

(Resin Particles)

By not direct contact of the porous layer possessed by the liquid absorption member to the coloring material layer of the first image but contact of it with the resin layer on the coloring material layer, adhesion of the coloring material to the porous layer or a partial loss of an image can be suppressed. The thickness (μm) of the resin layer is preferably 0.2 μm or more. The term "thickness of the resin layer" means the thickness of the resin layer after the liquid absorption step is performed. When the thickness of the resin layer is less than 0.2 μm, the resin layer is too thin so that repeated contact of the porous layer with the first image is likely to cause deformation of the resin layer. Deformation of the resin layer in the first image causes exposure of the coloring material layer and then, contact between the exposed coloring material layer with the porous layer may prevent sufficient suppression of the adhesion of the coloring material to the porous layer and moreover, a partial loss of an image. The thickness (μm) of the resin layer is, on the other hand, preferably 1.0 μm or less. The thickness of the resin layer can be adjusted by the amount of the resin particles or a water-soluble resin which will be described later, or particle size of the resin particles. The thickness of the resin layer is a value determined by observing the cross-section of the first image after the liquid absorption step or the cross-section of the recorded image through a scanning electron microscope (SEM), a transmission electron microscope (TEM) or the like.

The resin particles preferably have an anionic group. In the reaction liquid applying step, use of the anionic group-containing resin particles, though depending on the kind of the reactant, facilitates reaction with the reactant and aggregation of the resin particles. The resin layer thus formed therefore tends to become a layer having high strength, making it possible to more effectively suppress the adhesion of the coloring material to the porous layer contiguous to the resin layer and further, suppress a partial loss of a recorded image. Examples of the anionic group contained in the resin particles include —COOM, —$SO_3M$ and —$PO_3M_2$, in which Ms are each independently a hydrogen atom, an alkali metal, ammonium or an organic ammonium. The resin particles are more preferably at least one selected from the group consisting of acrylic resin particles and urethane resin particles. The acrylic resin particles and urethane resin particles can be selected from those exemplified above as a constituent of the acrylic resin and urethane resin in the first ink.

The content (mass %) of the resin particles in the second ink is preferably 1.0 mass % or more to 20.0 mass % or less based on the total mass of the second ink. When the content of the resin particles is less than 1.0 mass %, the resin layer thus formed is thin and tends to be deformed after the repeated contact of the porous layer with the first image. Deformation of the resin layer in the first image causes exposure of the coloring material layer and then, contact between the exposed coloring material layer with the porous layer may prevent sufficient suppression of the adhesion of the coloring material to the porous layer and a partial loss of an image. When the content of the resin particle exceeds 20.0 mass %, on the other hand, the resin layer thus formed becomes thick and the liquid component is not absorbed from the first image smoothly, making it impossible to sufficiently suppress curling or cockling which may occur due to absorption of the liquid component in the recording medium. The content (mass %) of the resin particles in the second ink is more preferably 2.0 mass % or more to 15.0 mass % or less based on the total mass of the second ink. The volume-based cumulative particle size at 50% ($D_{50}$) of the resin particles measured using a dynamic light scattering method is preferably 50 nm or more to 500 nm or less. The resin particles may be used either singly or in combination of two or more.

When the reaction liquid applying step is not performed, cationic group-containing resin particles can be used as the resin particles. The cationic group-containing resin particles may react with the anionic group-containing component in the ink (resin, self-dispersible pigment or the like) to aggregate the component in the ink. Compared with the reactant in the reaction liquid, however, the cationic group-containing resin particles do not have enough power to aggregate the component in the ink so that adhesion of the coloring material to the porous layer and a partial loss of an image cannot always be suppressed fully. Examples of the cationic group contained in the resin particles include ammonium group, pyridinium group and phosphonium group.

(Water-Soluble Resin)

The second ink preferably contains a water-soluble resin further. The water-soluble resin entering between the resin particles increases the strength of the resin layer thus formed. Even after the repeated contact of the porous layer with the first image, adhesion of the coloring material to the porous layer and a partial loss of a recorded image can therefore be suppressed effectively. The water-soluble resin is preferably an acrylic resin. Examples of the acrylic resin are similar to those exemplified above as the constituent of the acrylic resin in the first ink.

A ratio of the content (mass %) of the water-soluble resin in the second ink to the content (mass %) of the resin particles is preferably 0.05 time or more to 0.50 time or less. When the ratio is less than 0.05 time, the resulting resin layer not containing an adequate amount of the water-soluble resin with respect to the resin particles cannot easily have enhanced strength so that adhesion of the coloring material to the porous layer contiguous to the resin layer and a partial loss of an image cannot always be suppressed sufficiently. When the ratio exceeds 0.50 time, on the other hand, the resulting resin layer containing a large amount of the water-soluble resin with respect to the resin particles is likely to have enhanced strength. Even after the repeated contact of the porous layer with the first image, the separation of the resin layer does not occur easily so that adhesion of the coloring material to the porous layer can be suppressed more effectively. If the porous layer comes into contact with the first image and the liquid component contained in the porous layer decreases, however, the water-soluble resin aggregates while including the coloring material in the ink. Then, due to volume shrinkage caused by aggregation of the component in the ink, the image moves and a partial loss of the image cannot always be suppressed sufficiently.

The content (mass %) of the water-soluble resin in the second ink is preferably 0.3 mass % or more to 7.0 mass % or less, more preferably 0.5 mass % or more to 5.0 mass % or less, each based on the total mass of the second ink.

(Components Other than Resin Particles and Water-Soluble Resin)

As components other than the resin particles and the water-soluble resin, components similar to those exemplified above as the aqueous medium and other additives usable for the first ink can be used.

<Reaction Liquid>

Components constituting the reaction liquid to be used in the invention will next be described in detail. The content (mass %) of the coloring material in the reaction liquid is preferably 0.1 mass % or less based on the total mass of the reaction liquid, with 0.0 mass % being more preferred. The reaction liquid preferably contains no coloring material.

(Reactant)

The reaction liquid serves to aggregate anionic group-containing components (resin, self-dispersible pigment, and the like) in the ink through the contact with the ink and it contains a reactant. Examples of the reactant include multivalent metal ions, cationic components such as cationic resin and organic acids. Of these, organic acids are preferred as the reactant.

Examples of the multivalent metal ions include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$. In order to incorporate the multivalent metal ion in the reaction liquid, a multivalent metal salt (which may be a hydrate) obtained by bonding between the multivalent metal ion and an anion can be used. Examples of the anion include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4$ and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When the multivalent metal ion is used as the reactant, the content (mass %) of it in the reaction liquid in terms of a multivalent metal salt is preferably 1.0 mass % or more to 20.0 mass % or less based on the total mass of the reaction liquid.

The reaction liquid containing an organic acid has buffering capacity in an acid region (less than pH 7.0, preferably from pH 0.5 to 5.0) so that it causes aggregation while converting the anionic group of the component present in the ink into an acid form. Examples of the organic acid include monocarboxylic acids such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts or hydrogen salts thereof; tricarboxylic acids such as citric acid and trimellitic acid and salts or hydrogen salts thereof; and tetracarboxylic acids such as pyromellitic acid and salts or hydrogen salts thereof. Of these, the organic acid is preferably at least one of the dicarboxylic acids and salts or hydrogen salts thereof and the tricarboxylic acids and salts or hydrogen salts thereof. The content (mass %) of the organic acid in the reaction liquid is preferably 1.0 mass % or more to 50.0 mass % or less based on the total mass of the reaction liquid.

Examples of the cationic resin include resins having a primary to tertiary amine structure and resins having a quaternary ammonium salt structure. Specific examples include resins having a structure of vinylamine, allylamine, vinylimidazole, vinylpyridine, dimethylaminoethyl methacrylate, ethyleneimine or guanidine. The cationic resin may be used in combination with an acid compound or may be subjected to quaternization treatment to enhance its solubility in the reaction liquid. When the cationic resin is used as the reactant, the content (mass %) of the cationic resin in the reaction liquid is preferably 1.0 mass % or more to 40.0 mass % or less, more preferably 1.0 mass % or more to 10.0 mass % or less, each based on the total mass of the reaction liquid.

(Surfactant)

The reaction liquid preferably contains a surfactant. As the surfactant, at least one of a fluorine-based surfactant and a silicone-based surfactant is preferably used. The content (mass %) of the surfactant in the reaction liquid is preferably 0.1 mass % or more to 10.0 mass % or less, more preferably 2.0 mass % or more to 8.0 mass % or less, each based on the total mass of the reaction liquid.

First, a fluorine-based surfactant will be described in detail. A fluorine-based surfactant represented by $C_xF_{2x+1}$—$(CH_2)_y$—$(OCH_2CH_2)_Z$—OH can be used preferably. In this formula, $C_xF_{2x+1}$ represents a perfluoroalkyl group; x that defines the number of carbon atoms and fluorine atoms of the perfluoroalkyl group is preferably 4 or more to 6 or less; y represents the number of alkylene groups and is preferably 1 or more to 6 or less; and z represents the number of ethylene oxide groups and is preferably 1 or more to 50 or less, more preferably 1 or more to 20 or less, further more preferably 1 or more to 10 or less, particularly preferably 4 or more to 6 or less.

Examples of the fluorine-based surfactant include Surflon S-242, S-243, and S-420 (each, product of AGC Seimi Chemical); Megaface F-444 (product of DIC Corporation); and Zonyl FS-300, FSN, FSO-100 and FS-3100 (each, product of DuPont). Of these, a fluorine-based surfactant having 6 as x, more specifically, Zonyl FS-3100 is preferred.

Next, the silicone-based surfactant will be described in detail. As the silicone-based surfactant, that having a hydrophilic siloxane (—Si—O—) unit having a polyether chain and a hydrophobic siloxane unit having no polyether chain is preferred. Some silicone-based surfactants have a main chain with a polyether chain bonded thereto and some ones have a side chain with a polyether chain bonded thereto. The structure of the polyether chain is represented by —O—$(C_2H_4O)_a$—$(C_3H_6O)_b$—R, in which a stands for an integer of 1 or more, b stands for an integer of 0 or more, R represents a hydrogen atom or an alkyl group having 1 or more to 20 or less carbon atoms, $C_2H_4O$ is an ethylene oxide group and $C_3H_6O$ is a propylene oxide group. In a polyether-modified siloxane compound, ethylene oxide units and propylene oxide units may be present in any form in the structure of the compound, for example, at random or in block. Presence of these units at random means irregular arrangement of ethylene oxide units and propylene oxide units. Presence of these units in block means regular arrangement of blocks each comprised of some of the above-described units. Examples of the silicone-based surfactant include BYK-349, BYK-333 and BYK-3455 (each, product of BYK). Of these, a silicone-based surfactant having a side chain with a polyether chain bonded thereto, more specifically, BYK-349 is preferred.

(Other Components)

As the other components, components similar to those exemplified above as the aqueous medium and other additives usable for the ink can be used.

EXAMPLES

The invention will hereinafter be described in further detail by Examples and Comparative Examples. The invention is not limited by the following Examples insofar as it does not depart from the gist of the invention. With respect to the amount of components, all designations of "part or parts" and "%" are on a mass basis unless otherwise particularly indicated.

<Preparation of Pigment Dispersion>

A styrene-ethyl acrylate-acrylic acid copolymer (resin dispersant) having an acid value of 150 mgKOH/g and a weight average molecular weight of 8,000 was prepared. The resulting copolymer (20.0 parts) was neutralized with potassium hydroxide in an amount equimolar to the acid value of the copolymer and an adequate amount of pure water was added to prepare an aqueous solution of the resin dispersant having a resin content (solid content) of 20.0%. Then, 10.0 parts of a pigment (C.I. Pigment Blue 15:3), 15.0 parts of the aqueous solution of the resin dispersant and 75.0 parts of pure water were mixed. The resulting mixture and 200 parts of zirconia beads having a diameter of 0.3 mm were charged in a batch type vertical sand mill (product of Aimex) and the mixture was dispersed for 5 hours while cooling with water. Then, crude particles were removed by centrifugal separation, followed by pressure filtration through a cellulose acetate filter having a pore size of 3.0 μm (product of Advantec) to prepare a pigment dispersion having a pigment content of 10.0% and a resin dispersant content of 3.0%.

<Preparation of Resin Particle-Containing Liquid>

(Liquid Containing Resin Particles 1)

A solution was prepared by mixing 0.2 part of potassium persulfate and 74.0 parts of ion exchanged water. Then, an emulsified product was prepared by mixing 24.0 parts of ethyl methacrylate, 1.5 parts of methacrylic acid and 0.3 part of a reactive surfactant (Aqualon KH-05, product of DKS) to prepare an emulsified product. In a nitrogen atmosphere, the resulting emulsified product was added dropwise to the solution obtained above for one hour. While stirring at 80° C., polymerization reaction was performed, followed by stirring for further 2 hours. After cooling to room temperature, ion exchanged water and an aqueous potassium hydroxide solution were added to obtain a liquid containing anionic Resin particles 1 (resin content: 25.0%). Resin particles 1 were found to have a volume-based cumulative particle size (nm) at 50% of 210 nm.

(Liquid Containing Resin Particles 2)

A liquid containing anionic Resin particles 2 (resin content: 30.0%) was obtained by adjusting the concentration of a commercially available aqueous dispersion containing urethane resin particles (Takelac WS-5000, product of Mitsui Chemicals). Resin particles 2 were found to have a volume-based cumulative particle size at 50% (nm) of 70 nm.

(Liquid Containing Resin Particles 3)

A solution was prepared by mixing 0.2 part of potassium persulfate and 81.8 parts of ion exchanged water. Then, an emulsified product was prepared by mixing 16.1 parts of ethyl methacrylate, 1.6 parts of methoxypolyethylene glycol methacrylate (Blemmer PME1000 product of NOF) and 0.3 part of a reactive surfactant (Aqualon KH-05, product of DKS). In a nitrogen atmosphere, the resulting emulsified product was added dropwise to the solution obtained above for one hour. While stirring at 80° C., a polymerization reaction was performed, followed by stirring for further 2 hours. After cooling to room temperature, ion exchanged water and an aqueous potassium hydroxide solution were added to obtain a liquid containing nonionic Resin particles 3 (resin content: 15.0%). Resin particles 3 were found to have a volume-based cumulative particle size (nm) at 50% of 70 nm.

(Liquid Containing Resin Particles 4)

A solution was prepared by mixing 0.2 part of potassium persulfate and 78.8 parts of ion exchanged water. Then, an emulsified product was prepared by mixing 15.7 parts of ethyl methacrylate, 12.1 parts of methacryloxyethyltrimethyl ammonium chloride and 0.5 part of a reactive surfactant (Adeka Reasoap ER-20, product of Adeka Corporation) to prepare an emulsified product. In a nitrogen atmosphere, the resulting emulsified product was added dropwise to the solution obtained above for one hour. While stirring at 80° C., a polymerization reaction was performed, followed by stirring for further 2 hours. The water content of the reaction mixture was then adjusted by evaporation to obtain a liquid containing cationic Resin particles 4 (resin content: 40.0%). Resin particles 4 were found to have a volume-based cumulative particle size (nm) at 50% of 90 nm.

[Measurement of Volume-Based Cumulative Particle Size at 50% of Resin Particles]

The volume-based cumulative particle size at 50% of resin particles was measured by means of a particle size distribution analyzer (Nanotrac UPA-EX150, product of Nikkiso) adopting a dynamic light scattering method by using, as a measurement sample, a liquid obtained by diluting a resin particle-containing liquid with pure water to obtain a resin particle-containing liquid having a resin particle content of 1.0%. Measurement is performed under the following conditions: SetZero: 30 seconds, measurement times: 3, measurement time: 180 seconds, shape: true sphere and refractive index; 1.6.

<Preparation of Liquid Containing Water-Soluble Resin>

(Liquid Containing Water-Soluble Resin 1)

A styrene-ethyl acrylate-acrylic acid copolymer prepared by the conventional method was neutralized with an aqueous potassium hydroxide solution in an amount equimolar to an acid value of the copolymer and a liquid containing Water-soluble resin 1 having a resin content of 20.0% was prepared. The styrene-ethyl acrylate-acrylic acid copolymer has an acid value of 150 mgKOH/g and a weight average molecular weight of 8,000. Water-soluble resin 1 is anionic.

(Liquid Containing Water-Soluble Resin 2)

A liquid containing Water-soluble resin 2 having a polyvinylpyrrolidone K-15 (product of Tokyo Chemical Industry) content of 20.0% was prepared. Polyvinylpyrrolidone K-15 has a weight average molecular weight of 10,000. Water-soluble resin 2 is nonionic.

<Preparation of Ink>

(First Ink)

After mixing components (unit: %) listed in Table 1 and stirring the resulting mixture sufficiently, the reaction mixture was pressure filtered through Micro Filter having a pore size of 3.0 μm (product of Fujifilm) to prepare the first ink. Pluronic L-31 is a polyoxyethylene-polyoxypropylene copolymer produced by Adeka Corporation and Acetylenol E100 is a nonionic surfactant produced by Kawaken Fine Chemicals. The content (%) of the pigment in the first ink and the content (%) of the resin in the first ink are shown in the bottom columns of Table 1. The content of the resin in the first ink includes the water-soluble resin and the resin particles. The number added after the term "polyethylene glycol" is a number average molecular weight thereof.

TABLE 1

Composition and properties of first ink

| | No. of first ink 1 |
|---|---|
| Pigment dispersion | 35.0 |
| Liquid containing Resin particles 1 | 32.0 |
| Glycerin | 7.0 |
| Polyethylene glycol 100 | 3.0 |
| Liquid containing Water-soluble resin 1 | 1.0 |
| Pluronic L-31 | 3.0 |
| Acetylenol E100 | 0.5 |
| Water | 18.5 |
| Content (%) of pigment in first ink | 3.5 |
| Content (%) of resin in first ink | 9.3 |

(Second Ink)

After components listed in Tables 2 and 3 were mixed and sufficiently stirred, the reaction mixture was pressure filtered through Micro Filter having a pore size of 3.0 μm (product of Fujifilm) to prepare a second ink. The number added after the term "polyethylene glycol" is a number-average molecular weight thereof. Pluronic L-31 is a polyoxyethylene-polyoxypropylene copolymer produced by Adeka Corporation and Acetylenol E100 is a nonionic surfactant produced by Kawaken Fine Chemicals. The content (%) of the resin particles in the second ink and the content (%) of the water-soluble resin in the second ink are shown in the lower column of Tables 2 and 3. In addition, a mass ratio of the content of the water-soluble resin to the content of the resin particles in the second ink is shown in the bottom column of Tables 2 and 3.

TABLE 2

Composition and properties of second ink

| | No. of second ink | | | | | | |
|---|---|---|---|---|---|---|---|
| | 1 | 2 | 3 | 4 | 5 | 6 | 7 |
| Liquid containing Resin particles 1 | 40.0 | 6.0 | 12.0 | | | | 40.0 |
| Liquid containing Resin particles 2 | | | | 33.4 | | | |
| Liquid containing Resin particles 3 | | | | | 66.6 | | |
| Liquid containing Resin particles 4 | | | | | | 25.0 | |
| Liquid containing Water-soluble resin 1 | 10.0 | 2.0 | 5.0 | 10.0 | 10.0 | | |
| Liquid containing Water-soluble resin 2 | | | | | | | |
| Glycerin | 7.0 | 7.0 | 7.0 | 7.0 | 7.0 | 7.0 | 7.0 |
| Polyethylene glycol 1000 | 3.0 | 3.0 | 3.0 | 3.0 | 3.0 | 3.0 | 3.0 |
| Diethylene glycol | | | | | | | |
| Pluronic L-31 | 3.0 | 3.0 | 3.0 | 3.0 | 3.0 | | 3.0 |
| Acetylenol E100 | 0.5 | 0.5 | 0.5 | 0.5 | 0.5 | 0.5 | 0.5 |
| 2-Pyrrolidone-5-carboxylic acid | | | | | | | |
| Sodium hydroxide | | | | | | | |
| Water | 36.5 | 78.5 | 69.5 | 43.1 | 9.9 | 64.5 | 46.5 |
| Content E (%) of resin particles in second ink | 10.0 | 1.5 | 3.0 | 10.0 | 10.0 | 10.0 | 10.0 |
| Content S (%) of water-soluble resin in second ink | 2.0 | 0.4 | 1.0 | 2.0 | 2.0 | 0.0 | 0.0 |
| S/E Ratio | 0.20 | 0.27 | 0.33 | 0.20 | 0.20 | 0.00 | 0.00 |

TABLE 3

| Composition and properties of second ink | No. of second ink | | | | | | |
|---|---|---|---|---|---|---|---|
| | 8 | 9 | 10 | 11 | 12 | 13 | 14 |
| Liquid containing Resin particles 1 | 40.0 | 40.0 | 40.0 | 40.0 | | | |
| Liquid containing Resin particles 2 | | | | | | | |
| Liquid containing Resin particles 3 | | | | | | | |
| Liquid containing Resin particles 4 | | | | | | | |
| Liquid containing Water-soluble resin 1 | 1.5 | 2.5 | 25.0 | 35.0 | | 10.0 | |
| Liquid containing Water-soluble resin 2 | | | | | | | 10.0 |
| Glycerin | 7.0 | 7.0 | 7.0 | 7.0 | | 7.0 | 7.0 |
| Polyethylene glycol 1000 | 3.0 | 3.0 | 3.0 | 3.0 | | 3.0 | 3.0 |
| Diethylene glycol | | | | | 20.0 | | |
| Pluronic L-31 | 3.0 | 3.0 | 3.0 | 3.0 | | 3.0 | 3.0 |
| Acetylenol E100 | 0.5 | 0.5 | 0.5 | 0.5 | 1.0 | 0.5 | 0.5 |
| 2-Pyrrolidone-5-carboxylic acid | | | | | 1.0 | | |
| Sodium hydroxide | | | | | 0.25 | | |
| Water | 45.0 | 44.0 | 21.5 | 11.5 | 77.8 | 76.5 | 76.5 |
| Content E (%) of resin particles in second ink | 10.0 | 10.0 | 10.0 | 10.0 | 0.0 | 0.0 | 0.0 |
| Content S (%) of water-soluble resin in second ink | 0.3 | 0.5 | 5.0 | 7.0 | 0.0 | 2.0 | 2.0 |
| S/E ratio | 0.03 | 0.05 | 0.50 | 0.70 | — | — | — |

<Preparation of Reaction Liquid>

After components (unit: %) listed in Table 4 were mixed and the resulting mixture was stirred sufficiently, the reaction mixture was pressure filtered through Micro Filter having a pore size of 3.0 μm (product of Fujifilm) to prepare a reaction liquid. Zonyl FS-3100 is a nonionic fluorine-based surfactant produced by DuPont. BYK-349 is a silicone-based nonionic surfactant produced by BYK.

TABLE 4

| Composition of reaction liquid | No. of reaction liquid | | | | | | |
|---|---|---|---|---|---|---|---|
| | 1 | 2 | 3 | 4 | 5 | 6 | 7 |
| Malic acid | 30.0 | 30.0 | | | 30.0 | | |
| Citric acid | | | 30.0 | | | 30.0 | |
| Malonic acid | | | | 30.0 | | | 30.0 |
| Glycerin | 7.0 | 7.0 | 7.0 | 7.0 | 7.0 | 7.0 | 7.0 |
| Zonyl FS-3100 | 5.0 | | 5.0 | 5.0 | | | |
| BYK 349 | | 5.0 | | | | | |
| Acetylenol E100 | | | | | 1.0 | 1.0 | 1.0 |
| Water | 58.0 | 58.0 | 58.0 | 58.0 | 62.0 | 62.0 | 62.0 |

<Manufacture of Porous Body of Liquid Absorption Member>

A fibrillated porous layer was prepared as a first layer by performing compression molding of emulsion polymerization particles of a crystallized fluorine-based resin (polytetrafluoroethylene) and stretching the resulting molded product at a temperature not more than the melting point. The first layer thus prepared had a thickness of 25.0 μm and an average pore size of 0.4 μm.

As a second layer, a layer was prepared by the wet method while mixing an olefin resin (material made of monofilament of polyethylene and polypropylene). The second layer thus prepared had a thickness of 50.0 μm and an average pore size of 6.0 μm.

As a third layer, polyolefin-based nonwoven fabric HOP60 (product of Hirose Paper Mfg) was used. The first layer, the second layer and the third layer were thermally bonded to obtain a porous body.

[Measurement Method of Thickness and Average Particle Size of Layer]

The thickness (μm) and average pore size (μm) are determined by observing the cross-section of the porous layer by using a scanning electron microscope (SEM).

<Evaluation>

In the invention, AA, A or B is an acceptable level and C is an unacceptable level based on the below-described evaluation criteria. A combination of the reaction liquid, the first ink, and the second ink to be used in Examples, Comparative Examples and Referential Examples and application order and evaluation results of them are shown in Table 5.

Examples 1 to 16, Comparative Examples 1 to 9 and Referential Examples 1 and 2

An image was recorded using the transfer type ink jet recording apparatus shown in FIG. 1. A cylindrical drum made of aluminum was used as the support member 102. As a member of the surface layer of the transfer body 101, that obtained by coating a 0.5-mm thick polyethylene terephthalate (PET) sheet with 0.2-mm thick silicone rubber (KE12, product of Shin-Etsu Chemical) having a rubber hardness (Durometer type A) of 40° was used. The resulting surface was subjected to plasma surface treatment using a plasma surface treater (ST-7000, product of Keyence Corporation) under the conditions of treatment distance: 5 mm, plasma mode: High and treatment speed: 100 mm/sec. The surface was immersed for 10 seconds in a solution obtained by diluting a commercially available neutral detergent containing a sodium alkylbenzene sulfonate with pure water to give its concentration of 3%. Then, the surface was dried to obtain a member of the surface layer of the transfer body 101. The transfer body 101 thus obtained was fixed to the support member 102 with a double-side bonded tape.

The reaction liquid was loaded in the reaction liquid applying unit 103 and 1.0 g/m$^2$ of the reaction liquid was applied to the transfer body 101. The first ink and the second ink were loaded in the ink applying unit 104. Thermal energy was applied to the inks to eject them to the transfer body 101 by an on demand system. Application orders described in Table 5 were achieved by changing the arrangement of the reaction liquid applying unit 103 and the ink applying unit 104 as needed.

As the porous body to be used for the liquid absorption member 105*a*, the porous body manufactured above was used. The speed of the conveyance roller 105*c* for conveying the liquid absorption member was adjusted to be equal to the moving speed of the transfer body 101. The conveyance speed of the conveyance roller 105*c* was 0.4 m/s. The liquid absorption member 105*a* was immersed in a treatment liquid containing 95.0 parts of ethanol and 5.0 parts of water to impregnate the voids of the porous body with the liquid. Then, the liquid was replaced by water. A pressure was applied to the pressing member 105*b* to give an average nip pressure, between the transfer body 101 and the liquid absorption member 105*a*, of 4 kg/cm$^2$. The liquid absorption step using the liquid absorption member was not performed in Referential Examples 1 and 2.

Then, the recording medium 108 was conveyed using the recording medium delivery roller 107*a* and the recording medium winding roller 107*b* so as to make the conveyance speed equal to the moving speed of the transfer body 101 and the recording medium 108 was brought into contact with the first image between the transfer body 101 and the pressing member 106. The first image was thus transferred from the transfer body 101 to the recording medium 108. As the recording medium 108, coated paper (AURORA COAT coated paper, product of Nippon Paper Industries) was used. In the present Examples, the nip pressure between the transfer body 101 and the pressing member 106 was adjusted to 3 kg/cm$^2$.

Examples 17 to 30 and Comparative Examples 10 to 12

An image was recorded using a direct recording type ink jet recording apparatus shown in FIG. 2. The reaction liquid applying unit 203, the ink applying unit 204, the conveyance rate of the recording medium and the liquid absorption unit 205 were operated under conditions similar to those of the transfer type ink jet recording apparatus. As the recording medium 208, cast-coated paper (Gloria pure white paper, product of Gojo Paper Mfg) was used. The application order described in Table 5 was achieved by changing the arrangement of the reaction liquid applying unit 103 and the ink applying unit 104 as needed.

[Method of Measuring Thickness of Resin Layer]

The thickness (μm) of the resin layer is a value determined by observing the cross-section of an image after the liquid absorption step through a scanning electron microscope (SEM).

[Adhesion of Coloring Material to Porous Layer]

When the transfer type ink jet recording apparatus was used, a first image having a first ink recording duty of 200% and a second ink recording duty of 100% was formed on the transfer body and it was transferred to AURORA COAT coated paper to record an image (5 cm×5 cm solid image). When the direct recording type ink jet recording apparatus was used, on the other hand, an image (5 cm×5 cm solid image) having a first ink recording duty of 200% and a second ink recording duty of 100% was recorded on Gloria pure white paper. In the present Examples, an image recorded under conditions of applying 3.0 ng of ink droplets to a unit region of 1/1,200 inch×1/1,200 inch at a resolution of 1,200 dpi×1,200 dpi is defined as an image having a recording duty of 100%.

In Examples 15 and 30, the recording duty of the second ink was changed to 75% so that even when the second ink was applied, it did not entirely cover the coloring material layer and a portion of the coloring material layer was exposed.

After recording an image on a predetermined number of sheets of paper, adhesion of the coloring material to the porous layer possessed by the liquid absorption member 105*a* was observed. Adhesion of the coloring material to the porous layer was evaluated based on the following evaluation criteria.

AA: Adhesion of the coloring material was not observed even at the time of recording an image on 1.000 sheets of paper.

A: Adhesion of the coloring material was observed at the time of recording an image on 1,000 sheets of paper.

B: Adhesion of the coloring material was observed at the time of recording an image on 500 sheets of paper.

C: Adhesion of the coloring material was observed at the time of recording an image on 300 sheets of paper.

[Partial Loss of Image]

When the transfer type ink jet recording apparatus was used, an image was recorded by ejecting a first ink from one ejection orifice to a transfer body to form lines and applying a second ink having a recording duty of 100% so as to entirely cover the lines therewith. When the direct recording type ink jet recording apparatus was used, on the other hand, an image was recorded by ejecting a first ink from one ejection orifice to Gloria pure white paper to form lines and applying a second ink having a recording duty of 100% so as to entirely cover the lines therewith.

In Examples 15 and 30, the recording duty of the second ink was changed to 75% so that even when the second ink was applied, it did not entirely cover the lines and a portion of the lines was exposed.

After recording an image on a predetermined number of sheets, the lines of the image were observed under a microscope. A partial loss of the image was evaluated based on the following evaluation criteria.

AA: No ruggedness in line was observed even at the time of recording an image on 1,000 sheets of paper.

A: Ruggedness of lines was observed at the time of recording an image on 1,000 sheets of paper.

B: Ruggedness of lines was observed at the time of recording an image on 500 sheets of paper.

C: Ruggedness of lines was observed at the time of recording an image on 300 sheets of paper.

TABLE 5

Evaluation conditions and evaluation results

| | Evaluation conditions | | | | | Evaluation results | |
|---|---|---|---|---|---|---|---|
| | Kind of reaction liquid | Kind of first ink | Kind of second ink | Application order | Thickness of resin layer (μm) | Adhesion of coloring material to porous layer | Partial loss of image |
| Example 1 | 1 | 1 | 1 | Reaction liquid→First ink→Second ink | 0.9 | AA | AA |
| Example 2 | 2 | 1 | 1 | Reaction liquid→First ink→Second ink | 0.9 | AA | AA |

TABLE 5-continued

| Evaluation conditions and evaluation results | | | | | | | |
|---|---|---|---|---|---|---|---|
| | Evaluation conditions | | | | | Evaluation results | |
| | Kind of reaction liquid | Kind of first ink | Kind of second ink | Application order | Thickness of resin layer (μm) | Adhesion of coloring material to porous layer | Partial loss of image |
| Example 3 | 3 | 1 | 1 | Reaction liquid→First ink→Second ink | 0.9 | AA | AA |
| Example 4 | 4 | 1 | 1 | Reaction liquid→First ink→Second ink | 0.9 | AA | AA |
| Example 5 | 1 | 1 | 2 | Reaction liquid→First ink→Second ink | 0.1 | A | A |
| Example 6 | 1 | 1 | 3 | Reaction liquid→First ink→Second ink | 0.2 | AA | AA |
| Example 7 | 1 | 1 | 4 | Reaction liquid→First ink→Second ink | 0.9 | AA | AA |
| Example 8 | 1 | 1 | 5 | Reaction liquid→First ink→Second ink | 0.9 | A | A |
| Example 9 | — | 1 | 6 | First ink→Second ink | 0.9 | B | B |
| Example 10 | 1 | 1 | 7 | Reaction liquid→First ink→Second ink | 0.8 | A | A |
| Example 11 | 1 | 1 | 8 | Reaction liquid→First ink→Second ink | 0.8 | A | A |
| Example 12 | 1 | 1 | 9 | Reaction liquid→First ink→Second ink | 0.8 | AA | AA |
| Example 13 | 1 | 1 | 10 | Reaction liquid→First ink→Second ink | 0.9 | AA | AA |
| Example 14 | 1 | 1 | 11 | Reaction liquid→First ink→Second ink | 1.0 | AA | A |
| Example 15 | 1 | 1 | 1 | Reaction liquid→First ink→Second ink | 0.9 | A | A |
| Example 16 | 1 | 1 | 1 | First ink→Second ink→Reaction liquid | 0.9 | A | A |
| Example 17 | 5 | 1 | 1 | Reaction liquid→First ink→Second ink | 0.9 | AA | AA |
| Example 18 | 6 | 1 | 1 | Reaction liquid→First ink→Second ink | 0.9 | AA | AA |
| Example 19 | 7 | 1 | 1 | Reaction liquid→First ink→Second ink | 0.9 | AA | AA |
| Example 20 | 5 | 1 | 2 | Reaction liquid→First ink→Second ink | 0.1 | A | A |
| Example 21 | 5 | 1 | 3 | Reaction liquid→First ink→Second ink | 0.2 | AA | AA |
| Example 22 | 5 | 1 | 4 | Reaction liquid→First ink→Second ink | 0.9 | AA | AA |
| Example 23 | 5 | 1 | 5 | Reaction liquid→First ink→Second ink | 0.9 | A | A |
| Example 24 | — | 1 | 6 | First ink→Second ink | 0.9 | B | B |
| Example 25 | 5 | 1 | 7 | Reaction liquid→First ink→Second ink | 0.8 | A | A |
| Example 26 | 5 | 1 | 8 | Reaction liquid→First ink→Second ink | 0.8 | A | A |
| Example 27 | 5 | 1 | 9 | Reaction liquid→First ink→Second ink | 0.8 | AA | AA |
| Example 28 | 5 | 1 | 10 | Reaction liquid→First ink→Second ink | 0.9 | AA | AA |
| Example 29 | 5 | 1 | 11 | Reaction liquid→First ink→Second ink | 1.0 | AA | A |
| Example 30 | 5 | 1 | 1 | Reaction liquid→First ink→Second ink | 0.9 | A | A |
| Comp. Ex. 1 | — | 1 | 12 | First ink→Second ink | 0.0 | C | C |
| Comp. Ex. 2 | 1 | 1 | — | Reaction liquid→First ink | 0.0 | C | C |
| Comp. Ex. 3 | 1 | 1 | — | First ink→Reaction liquid | 0.0 | C | C |
| Comp. Ex. 4 | 1 | 1 | 13 | Reaction liquid→First ink→Second ink | 0.1 | C | C |
| Comp. Ex. 5 | 1 | 1 | 14 | Reaction liquid→First ink→Second ink | 0.1 | C | C |
| Comp. Ex. 6 | 1 | 1 | 1 | Reaction liquid→Second ink→First ink | 0.9 | C | C |
| Comp. Ex. 7 | 1 | 1 | 1 | Second ink→First ink→Reaction liquid | 0.9 | C | C |
| Comp. Ex. 8 | 1 | 1 | 1 | Second ink→Reaction liquid→First ink | 0.9 | C | C |
| Comp. Ex. 9 | — | 1 | 6 | Second ink→First ink | 0.9 | C | C |
| Comp. Ex. 10 | — | 1 | 12 | First ink→Second ink | 0.0 | C | C |
| Comp. Ex. 11 | 5 | 1 | — | Reaction liquid→First ink | 0.0 | C | C |
| Comp. Ex. 12 | 5 | 1 | 13 | Reaction liquid→First ink→Second ink | 0.1 | C | B |
| Ref. Ex. 1 | 1 | 1 | 1 | Reaction liquid→First ink→Second ink | 0.9 | AA | AA |
| Ref. Ex. 2 | 1 | 1 | — | Reaction liquid→First ink | 0.0 | AA | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131062, filed Jul. 4, 2017, and Japanese Patent Application No. 2018-111478, filed Jun. 11, 2018, which are hereby incorporated by reference herein in their entirety.

What is claimed is:

1. An ink jet recording method for recording an image on a recording medium using a water-based ink comprising a first ink and a second ink, the method comprising:

an image formation step of (i) applying a first ink comprising a coloring material to a first recording medium to form a coloring material layer, (ii) applying a second ink not comprising a coloring material but comprising resin particles onto the coloring material layer to form a resin layer, and (iii) forming a first image comprised of the coloring material layer and the resin layer; and a liquid absorption step of bringing a porous layer comprising a liquid absorption member into contact with the first image to absorb a liquid component from the first image.

2. The ink jet recording method according to claim 1, further comprising, prior to the image formation step, a reaction liquid applying step of applying a reaction liquid comprising a reactant to the first recording medium.

3. The ink jet recording method according to claim 2, wherein the reactant comprises an organic acid.

4. The ink jet recording method according to claim 3, wherein the content (mass %) of the organic acid in the reaction liquid is 1.0 mass % or more to 50.0 mass % or less based on the total mass of the reaction liquid.

5. The ink jet recording method according to claim 2, wherein the reaction liquid is applied to the first recording medium with a roller.

6. The ink jet recording method according to claim 1, wherein the first recording medium is a transfer body, and the method further comprises, after the liquid absorption step, a transfer step of transferring the first image of the first recording medium to the recording medium.

7. The ink jet recording method according to claim 1, wherein the resin layer has a thickness (μm) of 0.2 μm or more.

8. The ink jet recording method according to claim 1, wherein the second ink further comprises a water-soluble resin.

9. The ink jet recording method according to claim 8, wherein a ratio of a content (mass %) of the water-soluble resin in the second ink to a content (mass %) of the resin particles is 0.05 times or more to 0.50 times or less.

10. The ink jet recording method according to claim 8, wherein the content (mass %) of the water-soluble resin in the second ink is 0.3 mass % or more to 7.0 mass % or less based on the total mass of the second ink.

11. The ink jet recording method according to claim 1, wherein, in the image formation step, the second ink is applied to entirely cover the coloring material layer.

12. The ink jet recording method according to claim 1, wherein the content (mass %) of the resin particles in the second ink is 1.0 mass % or more to 20.0 mass % or less based on the total mass of the second ink.

13. An ink jet recording apparatus comprising (i) a unit for applying a second ink after application of a first ink and (ii) a unit for bringing a porous layer comprising a liquid absorption member into contact with a first image formed with the first ink and the second ink, wherein the first ink is a water-based ink comprising a coloring material, and wherein the second ink is a water-based ink not comprising a coloring material but comprising resin particles.

* * * * *